US006802665B2

(12) United States Patent
Brown

(10) Patent No.: US 6,802,665 B2
(45) Date of Patent: Oct. 12, 2004

(54) DEVICE FOR COUPLING WRITING UTENSILS

(76) Inventor: Alman Brown, 1100 Canyon Rd., Silver Spring, MD (US) 20904

( * ) Notice: Subject to any disclaimer, the term of this patent is extended or adjusted under 35 U.S.C. 154(b) by 0 days.

(21) Appl. No.: 10/799,700

(22) Filed: Mar. 15, 2004

(65) Prior Publication Data

US 2004/0179886 A1 Sep. 16, 2004

Related U.S. Application Data

(60) Provisional application No. 60/455,012, filed on Mar. 15, 2003.

(51) Int. Cl.[7] ..... A46B 5/02

(52) U.S. Cl. ..... 401/6; 401/48; 401/34; 15/443

(58) Field of Search ..... 401/6, 48, 34, 401/35, 16–18; 15/443–435

(56) References Cited

U.S. PATENT DOCUMENTS

| | | | | | |
|---|---|---|---|---|---|
| 72,435 | A | * | 12/1867 | Wheeler | 15/435 |
| 151,292 | A | * | 5/1874 | Jolly | 15/437 |
| 1,977,527 | A | * | 10/1934 | Pohle | 401/35 |
| 2,044,792 | A | * | 6/1936 | Hoyle | 401/35 |
| 2,510,302 | A | * | 6/1950 | White | 401/34 |
| 3,800,974 | A | * | 4/1974 | Mogel et al. | 220/23.4 |
| 5,263,259 | A | | 11/1993 | Cimador | |
| 5,318,372 | A | | 6/1994 | Besthorne | |
| 5,542,588 | A | | 8/1996 | Sison | |
| 5,899,619 | A | | 5/1999 | O'Shei | |
| 6,033,139 | A | | 3/2000 | Dutcher | |
| D470,530 | S | | 2/2003 | Moon | |

* cited by examiner

*Primary Examiner*—Gregory L. Huson
*Assistant Examiner*—Huyen Le
(74) *Attorney, Agent, or Firm*—Edell, Shapiro & Finnan, LLC

(57) ABSTRACT

A device for coupling writing utensils includes a first engagement member comprising an exterior wall and an interior wall defining a channel capable of receiving a first writing utensil; and a second engagement member including an exterior wall and an interior wall defining a channel capable of receiving a second writing utensil; wherein a portion of the first engagement member is tangentially connected to the second engagement member. The axis of the first engagement member is offset at a selected angle from the axis of the second engagement member, so as to form a generally X-shaped configuration.

10 Claims, 4 Drawing Sheets

DEVICE FOR COUPLING WRITING UTENSILS

CROSS REFERENCE TO RELATED APPLICATIONS

This application claims priority from U.S. Provisional Patent Application Ser. No. 60/455,012, entitled "Coupler for Writing Utensils", filed Mar. 15, 2003, the disclosure of which is incorporated herein by reference in its entirety.

BACKGROUND OF THE INVENTION

1. Field of the Invention

The present invention relates to writing accessories, in particular, to a device for coupling writing utensils that enables a user to hold and write with multiple writing instruments.

2. Description of the Related Art

In a variety of situations where writing utensils are used to mark a surface, it may be desirable to rapidly switch between two different writing utensils. In particular, it may be advantageous to alternately write with a pen and a pencil. Attempts have been made to address this problem in various ways.

For example, U.S. Pat. No. 5,318,372 (Besthorne) discloses a combination pen and pencil writing instrument including a connector member for joining the distal ends of a ballpoint pen and a lead pencil together. The connector mechanism comprises a hollow cylindrical collar that receives the distal end of the barrel of the ballpoint pen, as well as distal end of the casing of the lead pencil. The collar is fabricated out of a flexible rubber material, so that when the distal end of the barrel of the ballpoint pen is removed therefrom, the collar can be utilized as a pencil eraser for the lead pencil.

U.S. Pat. No. 5,899,619 (O'Shei) discloses a hand-marking device including two independent fluid reservoirs for holding liquids to be applied. The two independent refillable liquid reservoirs are in a back-to-back relationship with respect to one another.

U.S. Pat. No. 6,033,139 (Dutcher) discloses multiple penholder and drawing aid comprising a generally rectangular casing with holes in one side and retaining elements to hold drawing instruments such as dry erase markers, pens, and pencils. The retaining elements and holes are arranged such that the drawing instruments are retained in the casing with the tip ends extended outwardly through the holes. The user may then hold the drawing aid in one hand and use it to draw multiple parallel lines on a drawing surface.

While each of these devices provides certain efficiencies and advantages, there still exists a need for providing a writing device that enables a user to quickly and efficiently make successive markings on a surface with multiple writing instruments.

SUMMARY OF THE INVENTION

Therefore, in light of the above, and for other reasons that become apparent when the invention is fully described, an object of the present invention is to provide a device that couples various writing instruments.

It is another object of the present invention to provide a device that enables a user to efficiently mark surfaces using the utensils in an alternating fashion.

The aforesaid objects are achieved individually and in combination, and it is not intended that the present invention be construed as requiring two or more of the objects to be combined unless expressly required by the claims attached hereto.

In accordance with the present invention, a gripping device includes first and second engagement members, each of which receives a writing utensil. The members are connected tangentially; moreover, their axes are offset at a selected angle, forming a generally X-shaped configuration. With this configuration, the proximal ends of writing utensils may be used in an alternating fashion.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1A:
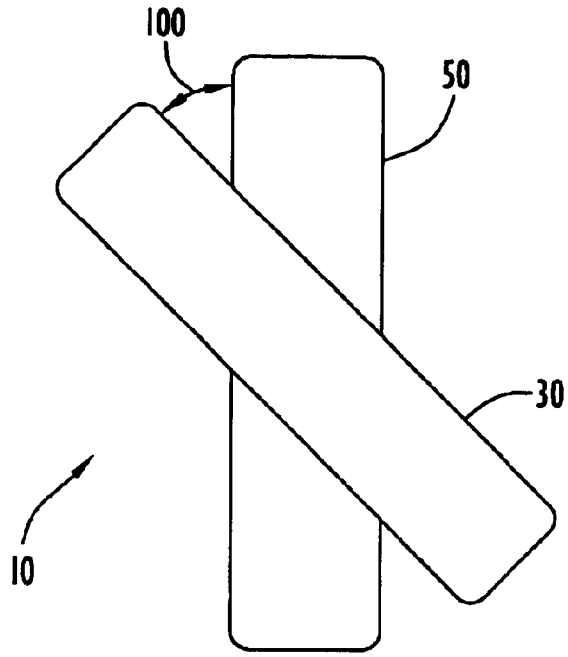
FIG. 1A is a plan view of one embodiment of the coupler device of the invention (a right-handed configuration).
Figure 1B:
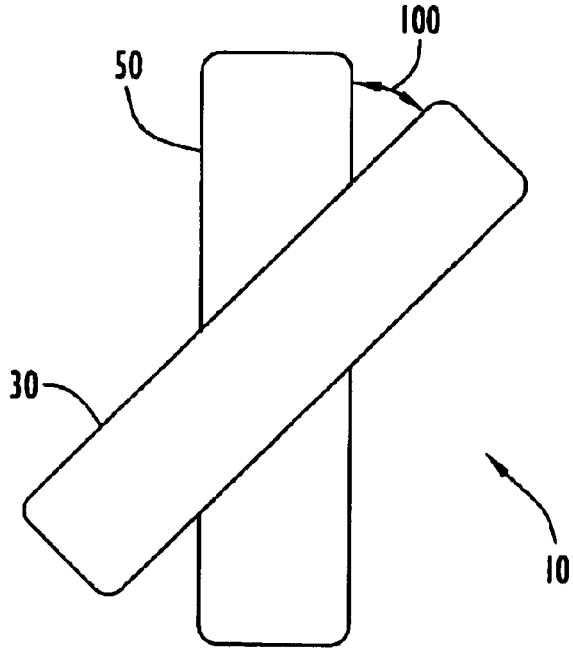
FIG. 1B is a plan view of another embodiment of the coupler device of the invention (a left-handed configuration).

Exemplary embodiments of the device for coupling a writing utensil (also called a writing instrument) are shown in FIGS. 1A and 1B. The device 10 includes a first engagement member 30 and a second engagement member 50. First member 30 is capable of receiving a writing utensil along a first axis. Similarly, second member 50 is capable of receiving a writing utensil along a second axis. The axis of first engagement member 30 is offset at a selected angle 100 from the axis of second engagement member 50, forming a generally X-shaped configuration.

Figure 2A:
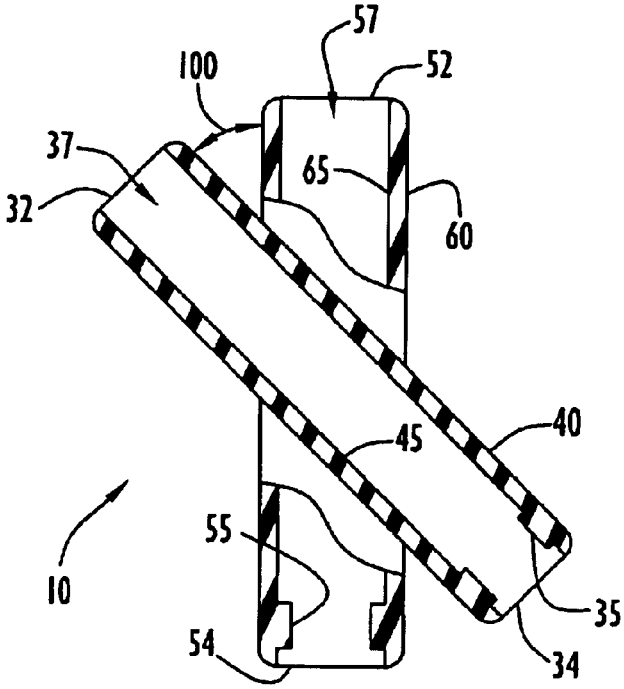
FIG. 2A is a plan view in cross section of the device of FIG. 1A.
Figure 2B:
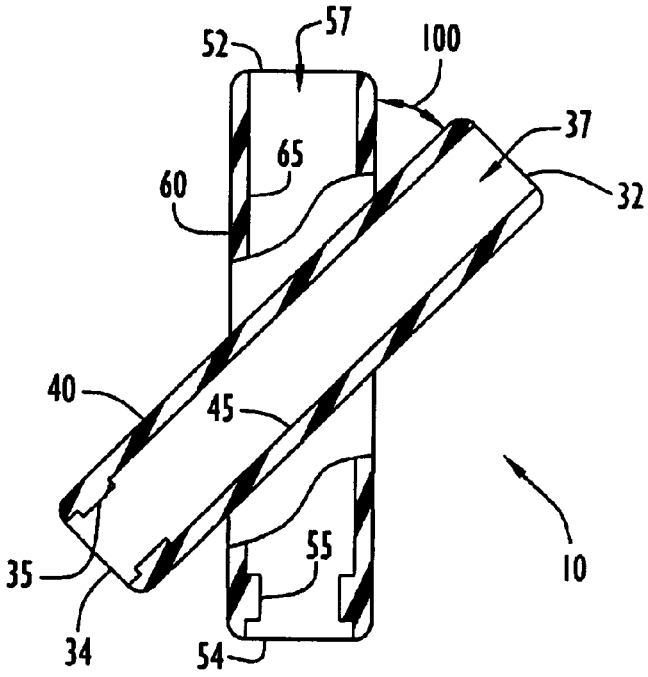
FIG. 2B is a plan view in cross section of the device of FIG. 2A.

Referring to FIGS. 2A and 2B, first engagement member 30 comprises a generally cylindrical tube. By way of non-limiting example, the length of the tube can be about 50 mm (or 2 inches). However, it will be understood that the length of the tube is not limited to any particular value. First member 30 includes an exterior wall 40 and an interior wall 45. The interior wall defines a substantially cylindrical channel 37 within member 30. The channel includes dimensions sufficient to removably receive a writing utensil. For example, the diameter of channel 37 can generally range from about 7–11 mm. If a standard pencil is used as the utensil of the first engagement member, then the diameter can be about 8 mm (or 5/16 of an inch). If a standard pen is used as the utensil, then the diameter can be about 9.5 mm (or 3/8 of an inch). It is to be understood, however, that the channel diameter is not limited to any particular value.

First member 30 further includes an opening 32 that defines an entry point for the writing utensil and an opening 34 that defines an exit point for the writing utensil (referred to as entry and exit, respectively). In use, the distal end of a writing utensil protrudes from entry 32, while the proximal end (i.e., the end used in writing) protrudes from exit 34.

A series of bosses 35 extends from a portion of the interior wall 45 of first member 30. Bosses 35 function not only to secure the writing utensil within the tube (i.e., to prevent its slipping), but also to prevent the utensil from traveling through the member and out the exit 34. Bosses 35 may be placed at any suitable location along interior wall 45 of channel 37. As a non-limiting example, bosses 35 may be positioned near exit 34 of first member 30; furthermore, they may be angularly spaced around interior wall 45 in a generally uniform manner. As another non-limiting example, bosses 35 can be uniformly positioned about 3 mm (or ⅛ of an inch) from exit 34. The number of bosses 35 is not limited; moreover, the bosses may be of any size or shape. By way of non-limiting example, if a standard pen is the intended writing utensil, the bosses are generally rectangular, having a length of about 6–7 mm (or ¼ of an inch), a width of about 1–2 mm (or 1/16 of an inch), and a height of about 1-2 mm (or 1/16 of an inch). If a standard pencil is the intended writing instrument, the length is preferably about 6–7 mm (or ¼ of an inch), the width is preferably about 1–2 mm (or 1/16 of an inch), and the height is preferably less than about 1 mm (or 1/32 of an inch). It is to be understood, however, that the dimensions of bosses 35 are not limited to any particular value.

The construction of second engagement member 50 is similar to hat of first engagement member 30. It comprises a generally cylindrical tube including an exterior wall 60 and an interior wall 65 that defines a substantially cylindrical channel 57. The dimensions of the tube (e.g., length and channel diameter) are similar to those of first member 30, described above. Second member 50 also includes an entry 52 and an exit 54 through which a writing utensil may be urged. When a writing instrument is inserted into second member 50, the distal end of the utensil protrudes from entry 52 and the proximal end protrudes from exit 54. Again similar to first member 30, second member 50 typically includes a series of bosses 55 extending from a portion of interior wall 65. The positioning and dimensions of bosses 55 are similar to that for first member 30, described above.

Figure 3:
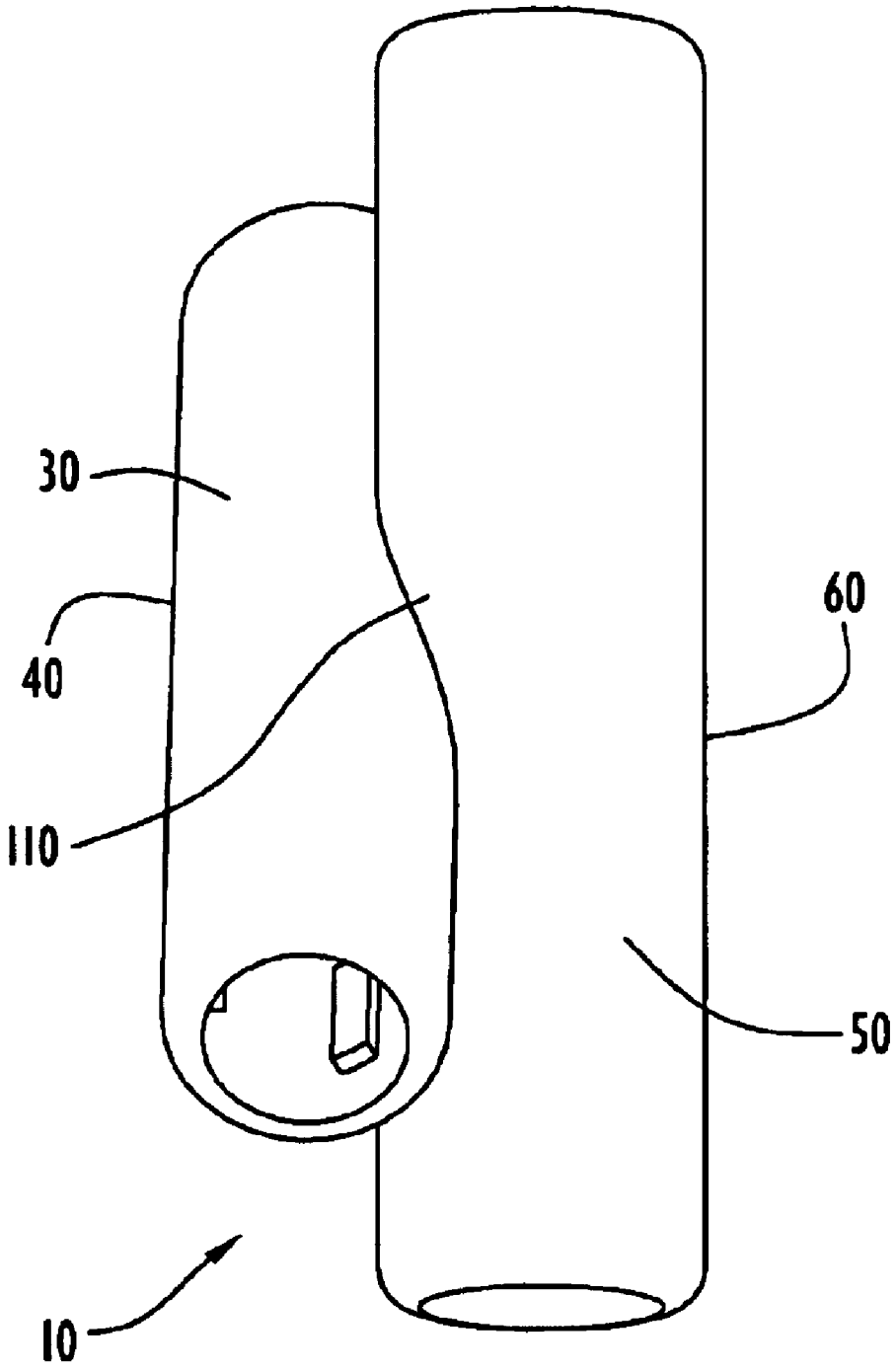
FIG. 3 is a side view of the device, showing the coupling of the engagement members.

FIG. 3 shows a view in perspective of device 10, with members configured such that first engagement member 30 is positioned on top of second engagement member 50. At least a portion of the first member adjoins the second member, with the members being connected tangentially at a connection point 110. In other words, members 30, 50 are secured to each other along a portion of their exterior walls 40, 60 at the point where the members intersect (in FIG. 3, this occurs at the approximate centers of the members). The manner of securing the members together is not limited. For example, the members may be attached using adhesives or welding, or may be manufactured such that the connection point forms a unitary structure (e.g., by injection molding, cast molding, or thermnoforming processes).

The axes if the members, moreover, are offset from each other, forming a generally X-shaped configuration. The angle of offset is not limited, and can be adjusted for a right-handed or left-handed user. By way of non-limiting example, the axis of first engagement member 30 can be offset about 45° from the axis of second engagement member 50 (FIG. 1A and 1B).

Figure 4:
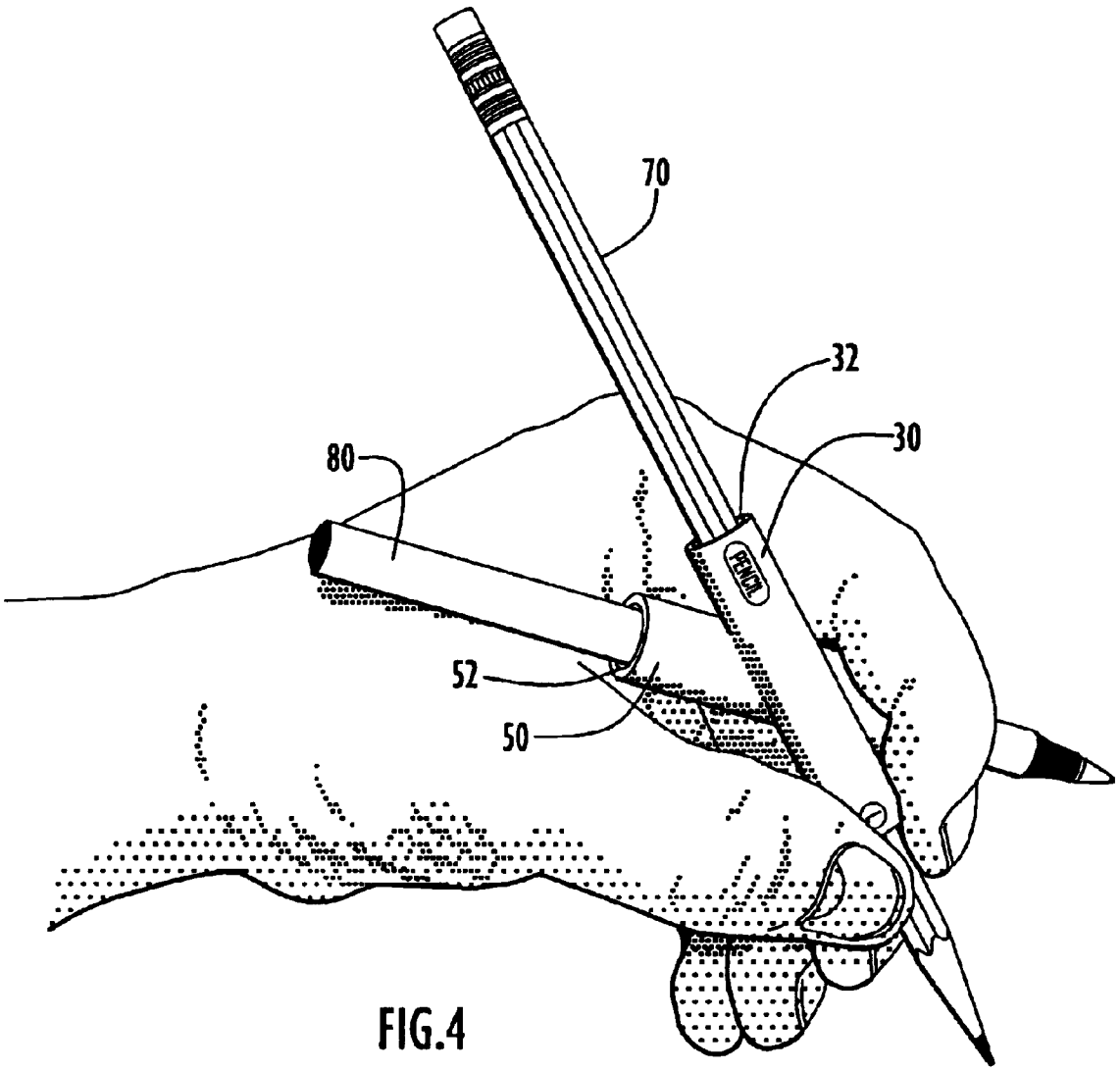
FIG. 4 is a view in perspective of the device of FIG. 1B in use.

An exemplary use of the device is shown in FIG. 4. The proximal end (i.e., the writing end) of a first writing utensil 70 (e.g., a pencil) is axially inserted into first engagement member 30 through entry 32. First utensil 70 is urged along the interior of first member 30 and through exit (not shown see 34 in FIGS. 2A and 2B) until the proximal end of utensil 70 extends a sufficient distance out of first member 30 and engages bosses (not shown, see 35 of FIGS. 2A and 2B). Then, the proximal end of a second writing utensil 80 (e.g., a pen) is axially inserted into second engagement member 50 through entry 52. Second utensil 80 is urged along the interior of second member 50 and through exit (not shown, see 54 in FIGS. 2A and 2B) until the proximal end of utensil 80 extends a sufficient distance out of the member 50 and engages bosses (not shown, see 55 of FIGS. 2A and 2B). A user selects an active utensil (i.e., the utensil to be used in writing; in FIG. 4, the pencil) by grasping the appropriate member 30 in the conventional manner using the left or right hand (in FIG. 4, the left hand). The user then writes using the active utensil. In use, the engagement member 50 that holds the inactive utensil (in FIG. 4, the pen) becomes a bridge on which the active utensil rests.

The engagement members may be of any size or shape. They are made of any suitable materials including wood, metal, plastic, rubber, or combinations thereof. Preferably, the members are made of a lightweight, rigid or semi-rigid material such as polyurethane. The engagement members may contain indicia on one or both sides to indicate, e.g., the appropriate hand designation (right-handed or left-handed), as well as the intended writing utensil (e.g., pen or pencil). The members may be of any length, width, or height. The exterior walls may have any geometrical configuration (e.g., circle, triangle, etc.) or may be stylized as a cartoon or real life character. The size and shape of the interior channel is not limited, so long as it receives a corresponding writing utensil. For example, though typically cylindrical, writing utensils are occasionally stylized as a triangle or a rectangle. The thickness of the member walls is not limited, but can be about 1.5 mm (or 1/16 of an inch).

The bosses may be of any number, size, or shape. Typically, they extend only along a portion of the interior wall 45, 65 but may extend the length of member 30, 50. If more than one boss exists, the distance between the bosses, when measured across the channel, can be about 6–7 mm (¼ of an inch). This distance, however, is not limited, and depends on several factors, including the channel diameter, the member wall thickness, and the boss height. The bosses, moreover, may be placed at any suitable location along the interior wall.

The writing utensils are not limited and include pens, pencils, and markers. The utensils may be or any size shape or composition. A standard pencil includes, e.g., lead and colored pencils. The pencils may be wood or mechanical. A specific example of a standard wood pencil is a Ticonderoga® pencil available from the Dixon® Ticonderoga® Company (Sandusky, Ohio). A standard pen includes, e.g., ballpoint, roller, felt-tipped, and retractable pens. A specific example of a standard ballpoint pen is a BIC® pen available from Société BIC (Clichy Cedex, France). The writing utensil positioned within the first engagement member may be the same or different from the writing utensil positioned within the second engagement member. A preferred example includes a standard pencil positioned within the first engagement member and a standard pen positioned within the second engagement member.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

I claim:

1. A device for writing utensils comprising:

a first engagement member including an exterior wall and an interior wall defining a channel that receives a first writing utensil along a first axis, wherein the channel extends from a first opening to a second opening; and a second engagement member including an exterior wall and an interior wall defining a channel that receives a second writing utensil along a second axis, wherein the channel extends from a first opening to a second opening;

wherein a portion of the first engagement member is tangentially connected to the second engagement member such that the first axis is offset at a selected angle from the second axis.

2. The device of claim 1, wherein the diameter of the first engagement member channel is different from the diameter of the second engagement member channel.

3. The device of claim 1, wherein at least one boss extends from at least a portion of the first member interior wall.

4. The device of claim 3, wherein at least one boss extends from at least a portion of the second member interior wall.

5. The device of claim 1 further including a first writing utensil positioned within the first engagement member and a second writing utensil positioned within the second engagement member.

6. The device of claim 5, wherein the first writing utensil differs from the second writing utensil.

7. The device of claim 6, wherein the first writing utensil is a pen and the second writing utensil is a pencil.

8. The device of claim 1, wherein the selected angle is about 45°.

9. A method of writing using the device of claim 1 including:

(a) inserting a first writing utensil into the first engagement member;

(b) inserting a second writing utensil into the second engagement member;

(c) selecting one of the first and second writing utensils as an active utensil; and (d) writing with the active utensil.

10. The method of claim 9, wherein (c) further includes:

positioning the device within a hand such that the second engagement member becomes a bridge on which the active utensil rests.

* * * * *